US005868461A

United States Patent [19]

Brotherston

[11] Patent Number: 5,868,461

[45] Date of Patent: Feb. 9, 1999

[54] RECLINING CHAIR

[75] Inventor: Ian Brotherston, Listowel, Canada

[73] Assignee: Broda Enterprises Inc., Waterloo, Canada

[21] Appl. No.: 877,161

[22] Filed: Jun. 17, 1997

[30] Foreign Application Priority Data

May 6, 1997 [CA] Canada ..... 2,204,579

[51] Int. Cl.[6] ..... A47C 1/02

[52] U.S. Cl. ..... 297/84; 5/618; 297/325; 297/354.13; 297/362.13

[58] Field of Search ..... 297/325, 316, 297/354.13, 362.13, 84, DIG. 4; 5/618, 614

[56] References Cited

PUBLICATIONS

Canadian Wheel Chair brochure entitled "Designed with Comfort in Mind!".

May Corporation brochure entitled "Posture–Guard".

Lumex brochure entitled "Preferred Care Recliner 565".

Optimum brochure entitled "Comfort Posturo–Pedic Chair—Model 890 & 900".

Homecrest Industries Incorporated brochure entitled "Get MAX Convalescent Chair".

*Primary Examiner*—Peter M. Cuomo

*Assistant Examiner*—Stephen Vu

*Attorney, Agent, or Firm*—Gowling, Strathy; D. Doak Horne

[57] ABSTRACT

A reclining chair having a back rest member which may be reclined. In one embodiment the reclining chair has means to allow it to be tilted. A pivotable joint is provided along the upper support members of the chair which allow such members to be pivotably bent proximate their midsection thereby allowing a greater degree of tilt of the seat member situate thereon than would otherwise be the case if there was no pivotable joint and the upper support members and the seat member thereon were tilted by simply lowering one end thereof. In another aspect, a lower leg support member is provided which rotatably extends upon the back rest of the chair being reclined, so as to support the calves of a user of the chair in a substantially horizontal position when the chair back is likewise reclined to a substantially horizontal position.

25 Claims, 5 Drawing Sheets

RECLINING CHAIR

FIELD OF THE INVENTION

The present invention relates to adjustably-positionable chairs, and more particularly to an adjustably reclinable chair which further is tiltable and/or possess an extendable lower leg support member which is activated upon the back rest of the chair being reclined.

BACKGROUND OF THE INVENTION

As society's population ages, and due to the significant advances in extending the average lifespan, there is a growing population of elderly people. The elderly are, on average, more likely to spend the daytime hours sitting, often for extended periods of time.

Furthermore, a significant portion of the aging elderly are ultimately institutionalized. Many residents of health care institutions, for a variety of health reasons, spend a large portion of their waking hours sitting.

Because of the increasing numbers of people who will engage in long-term and uninterrupted sitting activity, there is a need to provide chairs which comfortably accommodate these people. People who sit for long and uninterrupted periods of time are more comfortable if they are able to assume different seating positions during that period.

To accommodate long-term and uninterrupted seating by individuals, it is preferable to provide a chair whose back support may be reclined to substantially a horizontal position relative to the chair seat, allowing the user to effectively lie down without having to move from the chair. This is especially useful in the institutional health care environment in order to assist in providing proper nursing care without having to constantly physically move a patient from a chair to a bed and back again. In this respect, it is important to shift a resident's weight for comfort, to prevent skin breakdown from being seated in one position too long, and for certain specific medical treatments.

Further, chair seats may be tilted by providing a pivotable connection between the chair seat and a stationary chair frame. Chair seats which can be tilted increase user comfort and allow for changes in position to assist blood circulation when sitting for long periods, may assist in preventing injuries caused by poor posture.

Chairs can be designed to promote a significant amount of seat tilt and back recline by using hydraulically or electrically-powered mechanisms to cause movement of the chair frame members and, thereby, facilitating seat tilt and back recline. However, such chairs are prohibitively expensive, and this is a real concern to hospitals and institutions in an era of budgeting restraint.

Chairs that provide a significant amount of seat tilt by manual actuation are, in general, restricted in the amount of chair back recline that they can offer. This is due to physical limitations of current chair designs. In particular, when the chair set is in a titled position, movement of the back of the chair or other chair components will be restricted by either of:

any structure in the back of the chair;

the mechanisms which permit back recliner seat tilt; or;

the floor.

Accordingly, there exists a real need in the art for a manually operated reclinable chair which is manually adjustably positionable, capable of being fully reclined to substantially a horizontal position, and which can also achieve an appreciable degree of seat tilt.

It is also desirable for chairs having reclinable back feature to provide a means for supporting the lower legs and calves of a user of the chair in the horizontal position when the chair back rest is reclined and the user is lying with his/her back and substantially horizontal.

SUMMARY OF THE INVENTION

In order to provide a chair having degrees of incline substantially greater than prior art designs, yet of a relatively inexpensive configuration capable of being manually operated, in one of its broad aspects the present invention provides for a reclining chair having a seat which may be tilted, and a back rest which may be inclined if desired to a near horizontal position. Advantageously, the chair of the present invention may possess, by itself or in combination with the preceding design, means for allowing a lower leg support platform to be extended upon reclining of the back of the chair to allow horizontal support of the calves and lower legs of a user of the chair.

Accordingly, in one broad aspect of the reclining chair of the present invention, wherein provision is further made for such chair to be tiltable, such chair comprises:

a pair of substantially identical, parallel frame members, positioned in mutually-spaced apart relation with each other, each comprising an upper support member, a front member, a lower member, and a rear member;

the front member fixedly coupled at a lower end thereof to the lower member;

the upper support member pivotally coupled at one end thereof to an upper end of the front member;

the rear member coupled at one end thereof to the upper support member and at an opposite end thereof pivotally coupled to the lower member;

a back rest member disposed intermediate the frame members, having a point of pivotable coupling to corresponding upper support members of each of the frame members to allow the back rest member to be pivotally reclined from a substantially vertical position to an inclined position;

a seat member disposed intermediate the upper support members, positioned forwardly of the back rest member;

a pivotable joint within the upper support member to allow bending of the upper support member; and adjustable support means, adapted to cause the upper support member to resist a downward weight of a person sitting on the seat member.

In a preferred embodiment, the pivotable joint is located rearwardly of the seat member and intermediate the point of coupling of the upper member to the back rest member and the rear member. The rear member, at its lower end, is pivotally coupled to the frame (lower member). In such configuration, the upper support member advantageously may bend about its pivotable joint, thereby allowing a greater amount of rotation of the upper members, upon which the seat member is situate, thereby allowing a greater amount of tilt to the seat member for corresponding movement of the adjustable support member than would otherwise be the case if no pivotable joint was provided.

In a further inventive aspect of the reclining chair of the present invention, a lower leg support member is provided, which is pivotably coupled to two substantially parallel link arms. Such link arms are in turn each pivotally coupled to the back rest member. The lower leg support member is caused by such two link arm members to be pivotally rotated and extended to a substantially horizontal position upon reclining of the back rest member to a substantially horizontal position.

More particularly, such aspect of the invention comprises:

a lower leg support member disposed forwardly of the front member;

a lower link arm member, pivotably coupled at one end to said back rest member at a position thereon downwardly disposed from said point of pivotable coupling to aid upper support members and pivotably coupled at another end to said lower leg support member; and an upper link arm member, pivotably coupled at one end to said back rest member at a position thereon intermediate said point of pivotable coupling of said back rest member to said upper support members and said point of pivotable coupling of said back rest member to said lower link arm member, and pivotably coupled at another end to said lower leg support member at a position thereon spaced apart from said point of pivotable coupling to said lower link member.

Such feature may further be incorporated with the tiltable feature of the invention to provide a reclining, tiltable chair further having an extendable lower leg support member.

BRIEF DESCRIPTION OF THE DRAWINGS

Further objects and advantages will appear from the following detailed description of the invention, taken together with the following drawings in which.

DETAILED DESCRIPTION OF THE INVENTION

Figure 1:
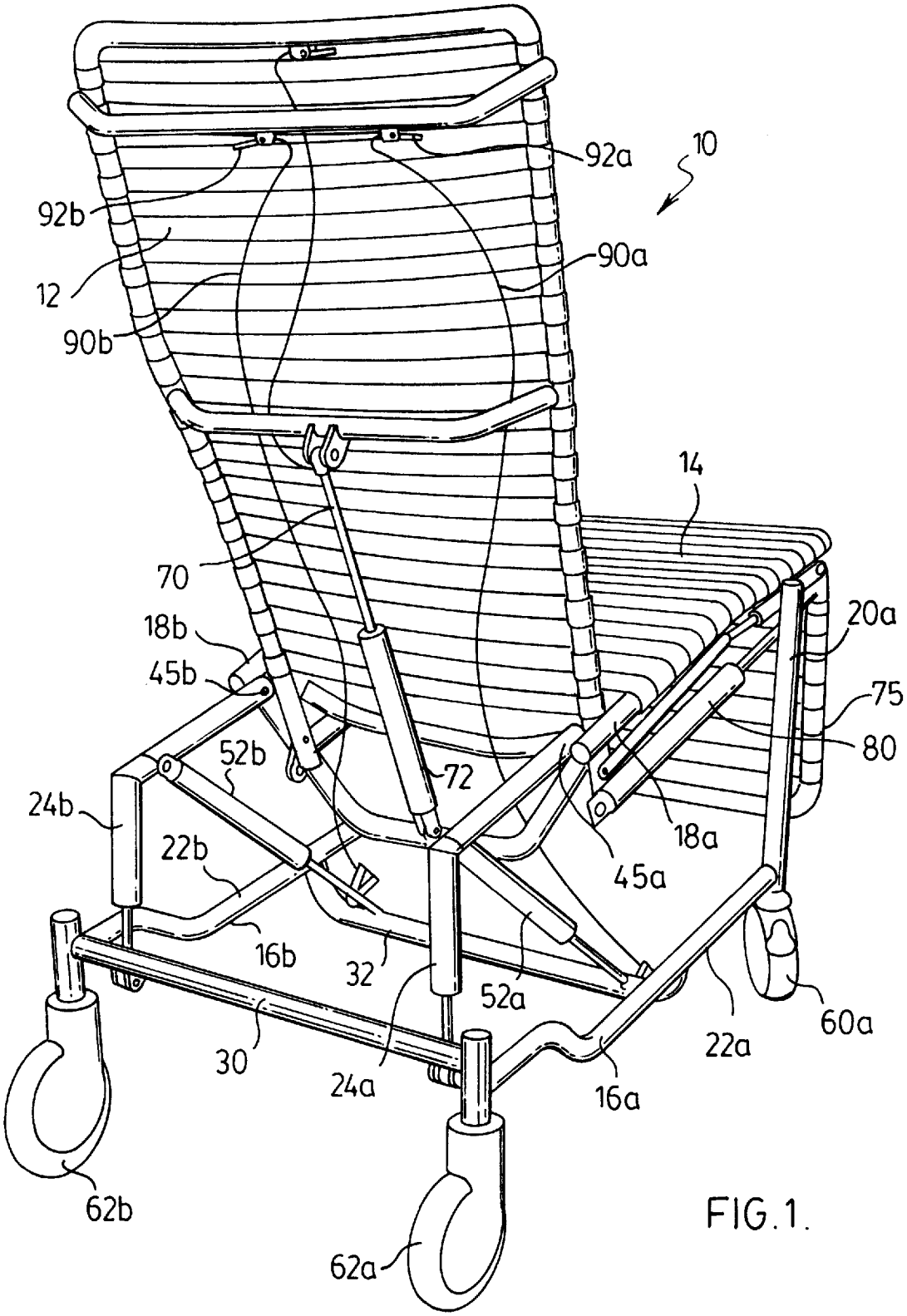
FIG. 1 is a perspective rear view of the reclining chair of the present invention, having means, in addition to allowing for the reclining of the back rest of the chair, providing for the tilting of the seat member of the chair and providing for support of lower legs of the user of the chair upon the back rest being reclined.

FIG. 1 shows a reclining chair 10 of the present invention specifically adapted for use by health care providers in moving and caring for patients who may be confined to chairs or beds. Such chair 10 is expressly provided with capability for adjustably reclining the back rest 12 thereof, and also for adjustably tilting the seat 14, and/or providing for the extension of a lower leg support member 75 to support the lower legs of a user (not shown) in a substantially horizontal position when the back rest 12 of the chair 10 is reclined to a substantially horizontal position.

Figure 2:
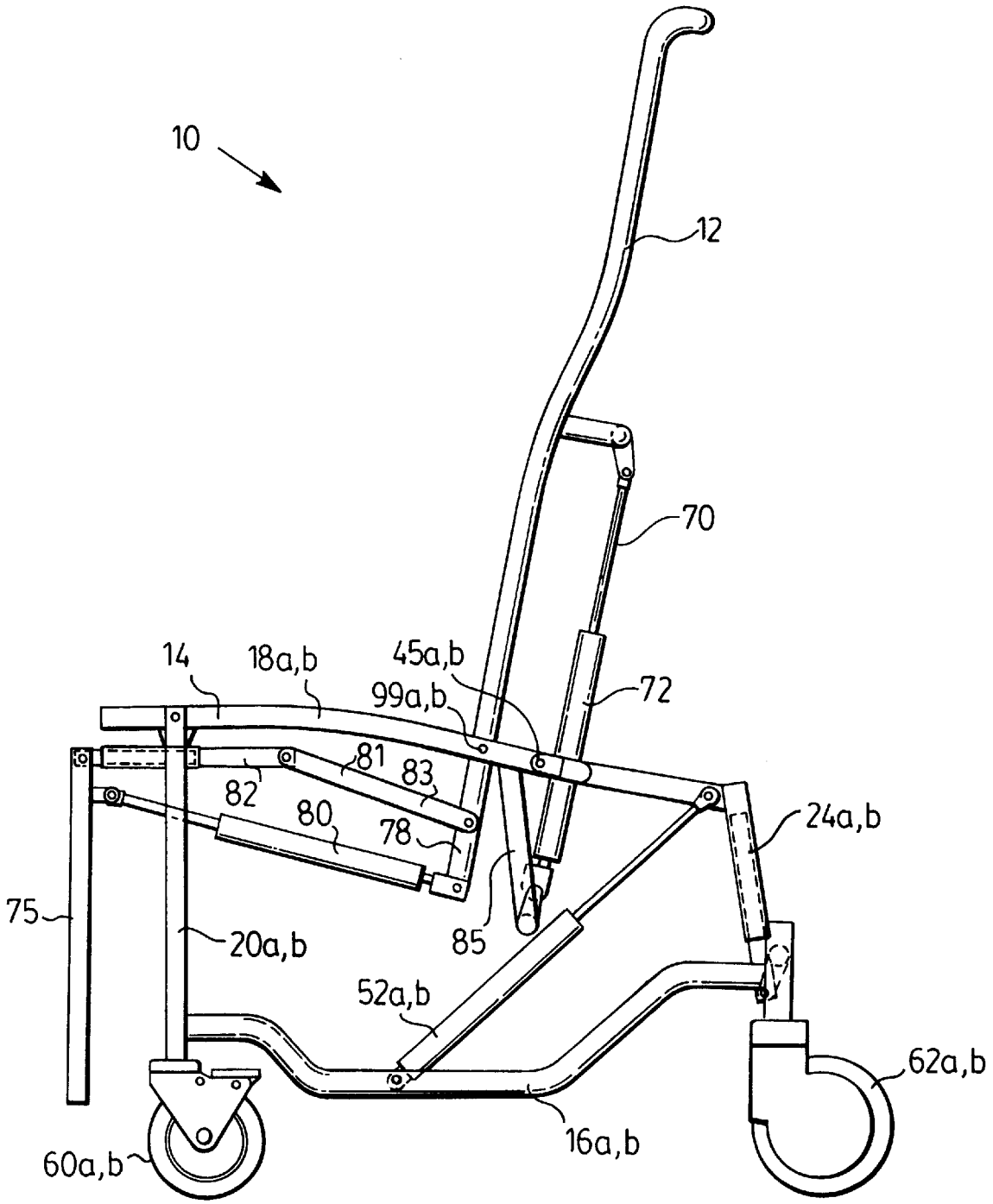
FIG. 2 is a side elevation view of the reclining chair of FIG. 1, showing the back rest in the substantially vertical position and the seat member substantially untilted.

As may be seen from FIGS. 1–4, the chair 10 of the present invention is constructed of a pair of substantially identical parallel left and right frame members 16*a* and 16*b* respectively, positioned in mutually spaced part relation with each other. The left and right frame members 16*a* and 16*b* are connected together by lateral struts 30 and 32 welded at their ends. Each of the left and right frame members 16*a*, 16*b* comprises upper support members 18*a*, 18*b*, front members 20*a*, 20*b*, lower members 22*a* and 22*b*, and rear members 24*a*, 24*b*, which together form quadrilateral sided frame members 16*a*, 16*b*. Each of the front vertical members 20*a*, 20*b* thereon are respectively fixedly coupled at a lower end thereof to lower horizontal members 22*a*, 22*b*. The upper members 18*a*, 18*b* are respectively pivotably coupled at one end thereof to an upper end of each front member 20*a*, 20*b*. The rear members 24*a*, 24*b* are coupled (in the preferred embodiment welded) at an upper end thereof to the respective upper support members 18*a*, 18*b* and at an opposite end thereof pivotably coupled to the respective lower members 22*a*, 22*b*, as best shown in FIGS. 1 & 2.

Figure 4:
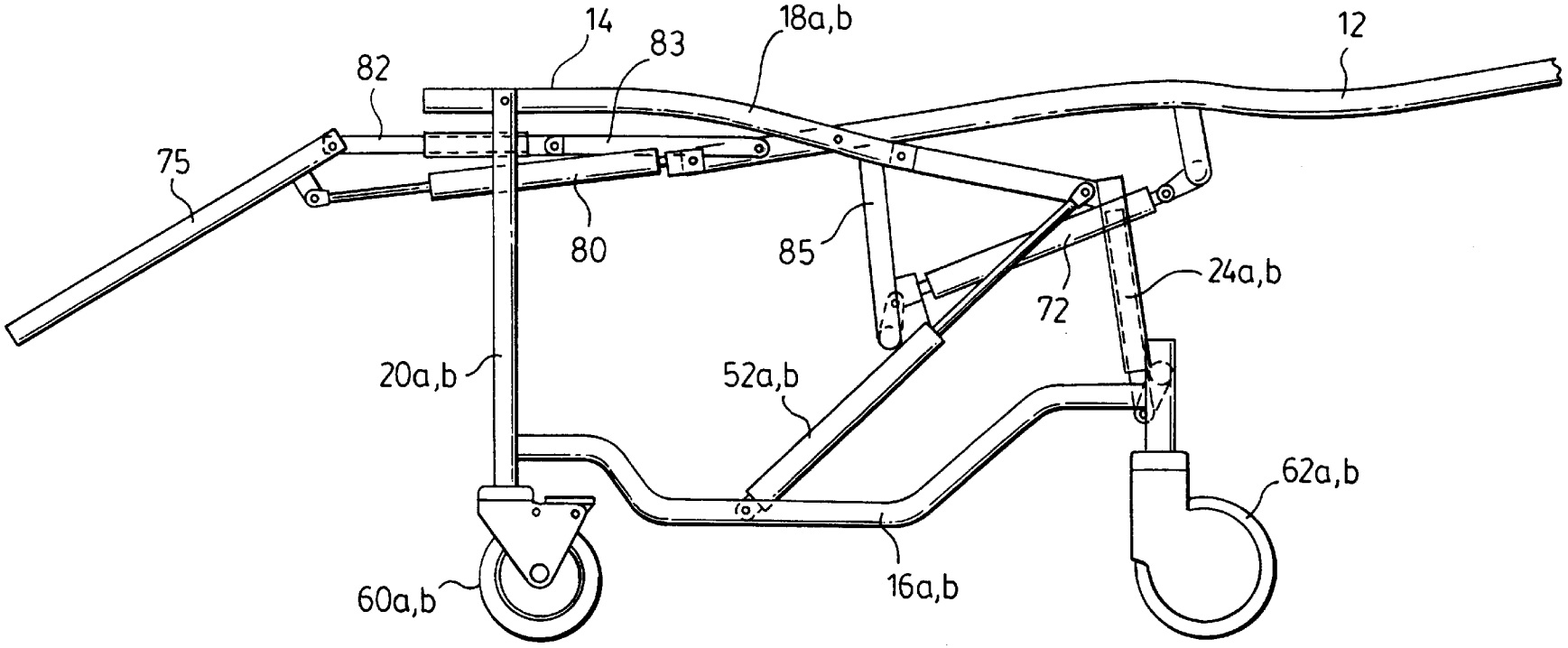
FIG. 4 is a her side elevation view of the reclining chair of FIG. 1, showing the back rest in the substantially horizontal (reclined) position, with the lower leg support member extended and rotated in substantially the horizonal position, with the seat in an untilted position.

Back rest member 12 is disposed intermediate the upper members 18*a*, 18*b*, and is pivotably coupled at each of its lateral side edge at point 99*a*, 99*b*, to corresponding upper support members 18*a*, 18*b* to allow such back rest member 12 to be pivotably reclined from a substantially vertical position, as shown in FIG. 1, to a substantially reclined position, as shown in FIG. 4.

A chair seat 14, is provided intermediate the upper support members 18*a*, 18*b* and is fixedly secured thereto immediately forward of the point of pivotable coupling 99*a*, 99*b* of the back rest member 12 to the upper support members 18*a*, 18*b*.

Importantly, the upper support members 18*a*, 18*b* each have pivotably joints 45*a*, 45*b*, to allow bending of the upper support members at a location proximate their midsection. In the preferred embodiment shown most clearly in FIGS. 2–4, such pivotable joint 45*a*, 45*b* is provided between the point of pivotable coupling 40 of the back rest member 12 to the upper support members 18*a*, 18*b*, and the point 50 of fixed attachment of the rear members 24*a*, 24*b* to the respective ends of the upper support members 18*a*, 18*b*.

Adjustable support means, in the form of extendable cylinder members 52*a*, 52*b* is provided. In the preferred embodiment shown in FIGS. 1–4 the extendable cylinder members 52*a*, 52*b* are gas pistons containing a compressible gas. A valve (not shown) can be closed to thereby prevent the transfer of gas within the cylinder to thereby lock the piston in the cylinder and thereby prevent retraction/extension thereof. The cylinders 52*a*, 52*b* may thus be releasibly locked in a desired position when the chair 10 is tilted to a desired position. In the preferred embodiment such valve is manually controlled by wires 90*a*, 90*b* and associated manual levers 92*a*, 92*b* which thereby control locking of cylinders 52*a*, 52*b* (see FIG. 1).

In the preferred embodiment the extendable cylinders 52*a*, 52*b* when locked exert an upward force on the corresponding upper support members 18*a*, 18*b* to thereby resist a downward weight of a peson sitting in the chair 10 on seat 14.

Figure 3:
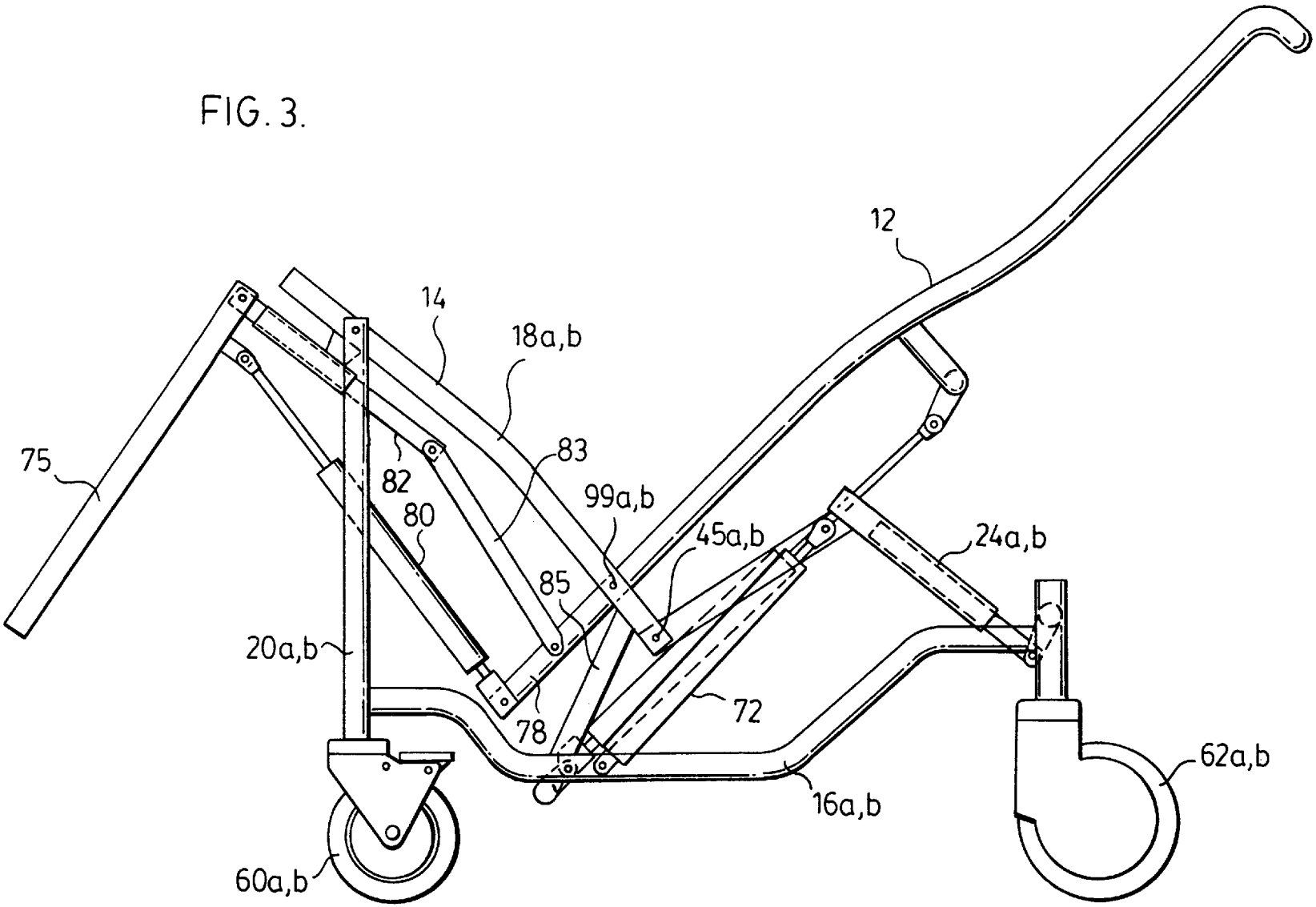
FIG. 3 is a side elevation view of the reclining chair of FIG. 1, showing the back rest in the substantially vertical position and the seat member of the chair in the fully tilted position.

The extendable cylinders 52*a*, 52*b*, which alternatively may comprise helical coil spring members as well as gas cylinders, are pivotably coupled at one end to the respective upper support members 18*a*, 18*b* rearward of the pivotable joint 45*a*, 45*b*, and pivotably coupled at an opposite end to the lower horizontal member 22*a*, 22*b*, as shown most clearly in FIGS. 2–4.

In the preferred embodiment of the chair 10 of the present invention, the extendable cylinders 52*a*, 52*b* are inclined at an angle as shown in FIGS. 2–4 so as to thereby direct an upward and rearward force on the upper support members 18A, 18*b*, so as to resist collapse of the upper support members 18*a*, 18*b* by rotation about the respective front members 20*a*, 20*b* and the pivotable joint 45*a*, 45*b*.

Advantageously, the pivotable joints 45*a*, 45*b* effectively allow the support members 18*a*, 18*b* to bend about their midsection, as shown in FIG. 3, thereby allowing greater tilt of the seat member 12 than would otherwise be the case in the configuration of the present design if such pivotable joints 45*a*, 45*b* were absent (see FIG. 3). The rear members 24*a*, 24*b* may further be made slidably extendable to allow the extendable cylinders 52*a*, 52*b* to push the upper support members 18*a*, 18*b* further upward so as to render the seat 12 more horizontal and eliminate tilt if desired.

Front wheels 60*a*, 60*b* and rear wheels 62*a*, 62*b* are further provided to allow health care professionals to easily transport patients who may be sitting or reclining in such chair 10.

In the preferred embodiment, the back rest member 12 of the reclining chair 10 of the present invention, in addition to being reclinable, is further provided with adjustable support means 70 adapted to support the back rest member 12 in a desired position. Such adjustable support means 70 may comprise a lockable helical spring, a ratchet mechanism, or as shown in the preferred embodiment in FIGS. 1–4, a releasably lockable gas cylinder 72, to allow the back rest 12 to be locked in a fixed position of inclination. In such embodiment, the cylinder 72 is pivotably coupled at one end to a strut 85 which is in turn fixedly coupled to the upper support members 18*a*, 18*b*, and is coupled at another end to the back rest member 12.

Figure 5A:
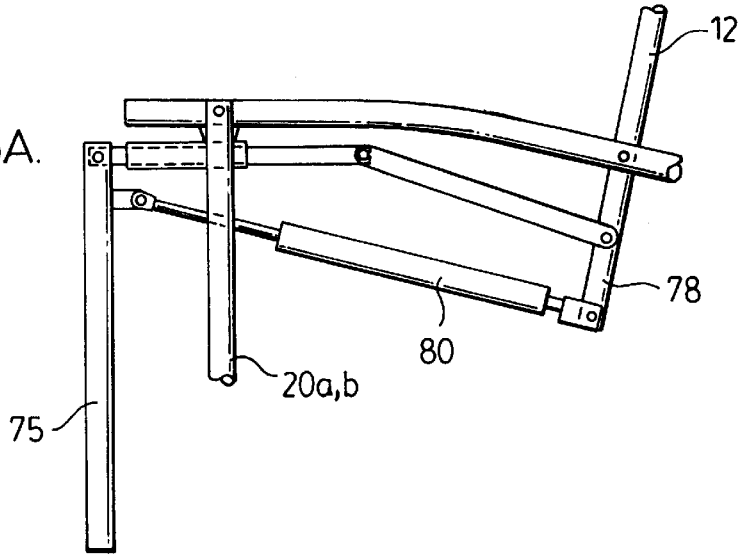
FIG. 5A is a detailed side elevation view of the back rest and lower leg support linkage of the reclining chair of the present invention, showing the back rest in the substantially vertical position and the lower leg support member in the unextended (retracted) position.
Figure 5B:
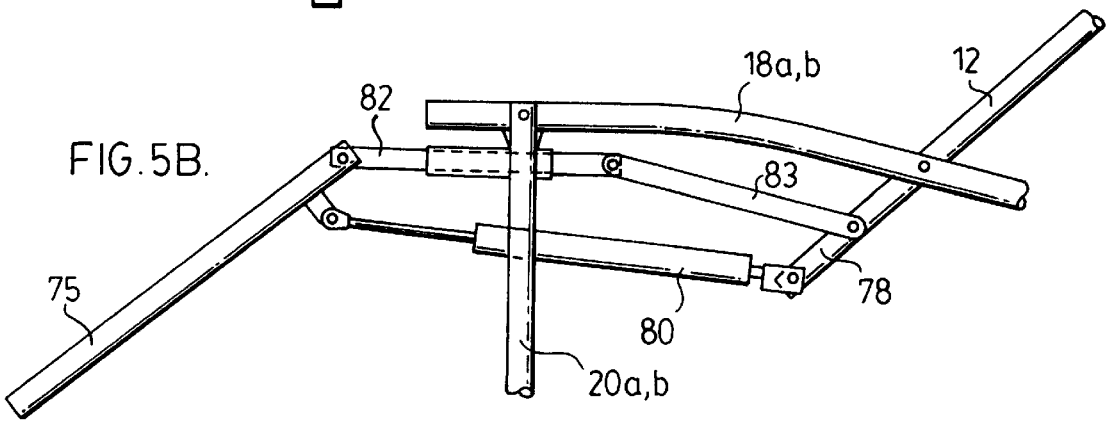
FIG. 5B is a detailed side elevation view of the back rest and lower leg support linkage components of the reclining chair of the present invention, showing the back rest in the partially reclined position, and the lower leg support member in the partially extended position.
Figure 5C:
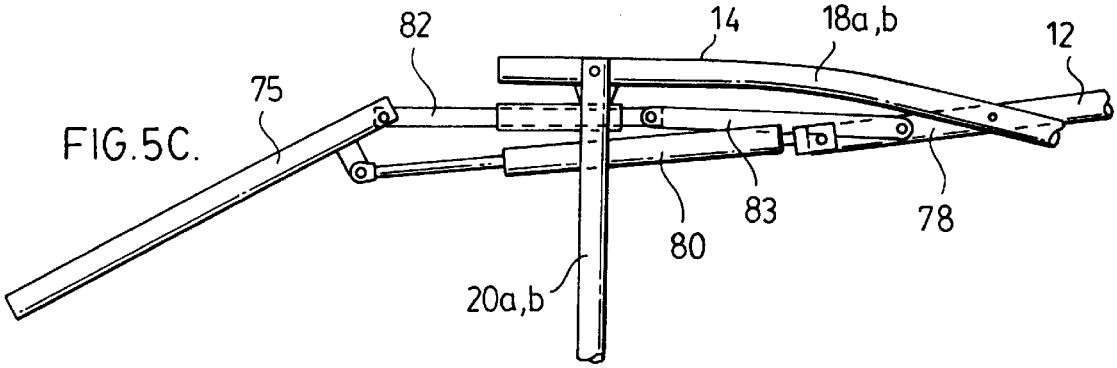
FIG. 5C is a detailed side elevation view of backrest and lower leg support linkage components of the reclining chair of the present invention, showing the back rest in the fully reclined position and the lower leg support member in the fully extended and substantially horizontal position.

In a preferred embodiment of the invention, shown in detail in FIGS. 5A–5C, a lower leg support member 75 is provided, pivotably coupled to the lower portion 78 of back rest member 12 via two substantially parallel link arm members 80, 81, which is rotatably extendable to a horizontal position upon the back rest member 12 being fully reclined to a horizontal position.

Upper link arm 81 is further comprised of two pivotably connected arms 82, 83. Lower link arm 80 is pivotably connected at one end to the lower leg support member 75 and at its other end its lower portion 78 of back rest member 12.

In operation, reclining of back rest member 12 by rotation about point of pivotable coupling 40 moves link arm members 80, 81 thereby causing lower leg support members 75 to extend and rotate to a substantially horizontal position, as shown in FIG. 5C, to thereby allow support of the legs of a person utilizing the chair 10 of the present invention when the back member 12 is reclined. Lower link arm member 80 is shown to be an adjustably extendable piston, which is necessary when the reclining chair of the present invention further possesses tilt features, but may be a fixed length link if such features are not present.

Although the disclosure describes and illustrated preferred embodiments of the invention, it is to be understood that the invention is not limited to these particular embodiments. Many variations and modifications will now occur to those skilled in the art. For definition of the invention, reference is to be made to the appended claims.

We claim:

1. A reclining, tiltable chair, comprising:

a pair of substantially identical, parallel frame members, positioned in mutually spaced apart relation with each other, each of said frame members comprising an upper support member, a front member, a lower member, and a rear member;

said front member fixedly coupled at a lower end thereof to said lower member;

said upper support member pivotably coupled at one end thereof to an upper end of said front member;

said rear member coupled at an upper end thereof to said upper support member and at opposite end thereof pivotably coupled to said lower member;

a back rest member disposed intermediate said frame members, having a point of pivotable coupling to said upper support members of each of said frame members to allow said back rest member to be pivotably reclined from a substantially vertical position to an inclined position;

a seat member located intermediate said upper support members, positioned forwardly of the back rest member;

said upper support member having opposite end and a pivotable joint untermediate said opposite ends thereof to allow bending of said upper support member; and adjustable support means, adapted to cause said upper support member to resist a downward weight of a person sitting on said seat member.

2. A reclining, tiltable chair as claimed in claim 1, said pivotable joint situated on said upper member intermediate said point of coupling of said upper member to said back rest member and said rear member.

3. The reclining, tiltable chair as claimed in claim 2, wherein said adjustable support means is releasably lockable.

4. The reclining, tiltable chair as claimed in claim 3, said adjustable support means comprising an extendable cylinder member, pivotably coupled at one end to said upper support member and adapted to apply an upward force on said upper support member.

5. The reclining, tiltable chair as claimed in claim 4, said extendable cylinder member pivotably coupled at one end thereof to said upper support member rearward of said pivotable joint.

6. The reclining, tiltable chair as claimed in claim 5, said extendable cylinder member pivotably coupled at an opposite end thereof to said lower member, further adapted to apply a rearward force on said upper support member.

7. The reclining, tiltable chair as claimed in claim 1, wherein said adjustable support means and said rear member are two separate components.

8. The reclining, tiltable chair as claimed in claim 7, wherein said rear member is fixedly coupled to said upper member rearward of said pivotable joint, and pivotably coupled at an opposite end to said lower member.

9. The reclining, tiltable chair as claimed in claim 8, wherein said rear member is a variable length member which may be caused to slidably extend or retract.

10. The reclining, tiltable chair as claimed in claim 4, said back rest member further having adjustable support means adapted to support said back rest member in a desired position.

11. The reclining, tiltable chair as claimed in claim 10, said support means for said back rest member comprising an extendable member, said extendable member releasably lockable to allow said back rest member to be held in a fixed position of inclination.

12. The reclining, tiltable chair as claimed in claim 11, said extendable member for said back rest member being pivotably coupled at one end to said upper member and at another end to said back rest member.

13. A reclining, tiltable chair, comprising a pair of substantially parallel frame members, positioned in mutually-spaced apart from each other, each of said frame members comprising an upper support member, a front member, a lower member, and a variable length rear member;

said front member fixedly coupled at a lower end thereof to said lower member;

said upper support member pivotably coupled at a first end thereof to an upper end of said front member;

said variable length rear member pivotably coupled at a lower end thereof to said lower member, and at an upper end thereof coupled to a second end of said upper support member;

a back rest member disposed intermediate said frame members, pivotably coupled to said upper support members at a point of pivotable coupling to said upper support members situated approximately intermediate first and second ends thereof to allow said back rest member to be pivotably reclined from a substantially vertical position to an inclined position;

a seat member situate intermediate said upper support members, positioned forwardly of the back rest member;

the upper support member, intermediate the point of pivotable coupling to the back rest member and said second end thereof, having a pivotable joint to allow bending of the upper support member and thereby tilting of said seat member situated therebetween; and an extendable cylinder member pivotably coupled at one end thereof to the corresponding upper support member, adapted to exert an upward and rearward force on said upper support member, and pivotably coupled at its other end to said lower member, adapted to cause said upper support member to resist a downward weight of a person sitting on said seat member.

14. The reclining, tiltable chair as claimed in claim 13, wherein said extendable cylinder member is releasably lockable to allow the seat member to be fixedly held in a desired tilt.

15. The reclining, tiltable chair as claimed in claim 14, wherein said extendable cylinder member is fixedly coupled at one end to said upper support member rearward of said pivotable joint, and at an opposite end thereof pivotably coupled to said lower member.

16. The reclining, tiltable chair as claimed in claim 13, said back rest member further having support means adapted to support said back rest member.

17. The reclining, tiltable chair as claimed in claim 16, said support means for said back rest member comprising an extendable cylinder member, said cylinder member releasably lockable to allow said back rest member to be held in a fixed position of inclination.

18. The reclining, tiltable chair as claimed in claim 13, further having two pairs of rolling means, a first pair located respectively proximate the point of fixed coupling of said first member to said lower member, and extending downwardly from said lower member, and a second pair located respectively at an opposite end of a respective lower member and extending downwardly therefrom.

19. The reclining, tiltable chair as claimed in claim 18, wherein said rolling means comprise wheels.

20. A reclining, tiltable, portable chair suitable for geriatric patients and invalids, comprising:

a pair of substantially parallel frame members, positioned in mutually spaced apart relation with each other, each of said frame members comprising a substantially horizontal upper support member, a substantially vertical front member, a lower substantially horizontal lower member, and a rear member;

said front member fixedly coupled at a lower end thereof to said lower horizontal member;

said upper support member pivotably coupled at one end thereof to said front member proximate an upper end thereof;

said rear member fixedly coupled at one end thereof to said upper support member and at opposite end thereof pivotably coupled to said lower horizontal member;

a back rest member disposed intermediate said frame members, having a point of pivotable coupling to said upper support members of each of said frame members to allow said back rest member to be pivotably reclined from a substantially vertical position to an inclined position;

a seat member located intermediate said upper support members, positioned forwardly of the back rest member;

said upper support member, at a position thereon intermediate said point of pivotable coupling to said back rest member and said rear member, having a pivotable joint to allow bending of said upper support member;

adjustable support means, adapted to cause said upper support member to resist a downward weight of a person sitting on said seat member, comprising an extendable member, pivotably coupled at one end to said upper support member rearward of said pivotable joint; and first and second pairs of wheel means, said first pair located respectively proximate the point of fixed coupling of each of said first member to said lower horizontal member, and extending downwardly from said lower horizontal member, and said second pair located respectively at an opposite end of said support member and extending downwardly therefrom.

21. A reclining chair, comprising:

a pair of substantially parallel frame members, positioned in mutually spaced apart relation to each other, each of said frame member comprising an upper support member, a front member, a lower member, and a rear member;

a back rest member disposed intermediate said frame members, one end thereof extending below said upper support member, having a point of pivotable coupling to said upper support members of each of said frame members to allow said back member to be pivotably reclined from a substantially vertical position to an inclined position;

a seat member located intermediate said upper support members, positioned forwardly of said back rest member;

a lower leg support member disposed forwardly of said front member;

a lower link arm member, pivotably coupled at one end to said back rest member at a position thereon downwardly disposed from said point of pivotable coupling to said upper support members and pivotably coupled at another end to said lower leg support member; and an upper link arm member, pivotably coupled at one end to said back rest member at a position thereon intermediate said point of pivotable coupling of said back rest member to said upper support members and said point of pivotable coupling of said back rest member to said lower link arm member, and pivotably coupled at another end to said lower leg support member at a position thereon spaced apart from said point of pivotable coupling to said lower link member.

22. The reclining chair as claimed in claim 21, said upper link arm member at a position thereon intermediate said point of pivotable coupling to said back rest member and said point of pivotable coupling to said leg rest member having a pivotable joint to allow bending of said leg rest extension member when said back rest member is pivotably reclined from a substantially vertical position to an inclined position.

23. The reclining chair as claimed in claim 21, said upper link arm member being slidingly received by a support member, said support member fixedly coupled to said upper support member.

24. The reclining chair as claimed in claim 21, said lower link arm member being adjustable in length.

25. The reclining chair as claimed in claim 24, said lower link arm comprising an extendable cylinder which may be releasibly locked to thereby fix its length.

* * * * *